United States Patent [19]

Bleuel et al.

[11] Patent Number: 4,918,804

[45] Date of Patent: Apr. 24, 1990

[54] MODULAR APPLICATION TOOLING FOR ELECTRICAL CONNECTORS

[75] Inventors: Eric P. Bleuel, Woodridge; Peter Ingwersen, Gilberts; Leonard J. Lickus, Plainfield; Thomas P. Pellegrino, Lisle; Hasmukh Shah, Wheaton; Robert A. Suthard, Woodridge, all of Ill.

[73] Assignee: Molex Incorporated

[21] Appl. No.: 320,021

[22] Filed: Mar. 6, 1989

[51] Int. Cl.[5] ..... H01R 43/00

[52] U.S. Cl. ..... 29/33 M; 29/564; 29/747; 29/755; 29/759

[58] Field of Search ..... 29/33 M, 564, 747, 755, 29/761, 759, 564.1, 564.6

[56] References Cited

U.S. PATENT DOCUMENTS

| | | | |
|---|---|---|---|
| 2,550,156 | 4/1951 | Lyon . | |
| 2,873,513 | 2/1959 | Carlzen et al. . | |
| 4,015,706 | 4/1977 | Goffredo et al. . | |
| 4,046,248 | 9/1977 | Goffredo et al. . | |
| 4,114,253 | 9/1978 | Loomis et al. | 29/753 |
| 4,238,874 | 12/1980 | Chandler et al. | 29/753 |
| 4,292,734 | 10/1981 | Swanson et al. . | |
| 4,395,818 | 8/1983 | Jackson | 29/747 |
| 4,404,743 | 9/1983 | Brandewie et al. | 29/75 |
| 4,428,114 | 1/1984 | Teagno | 29/748 |
| 4,493,147 | 1/1985 | Bakermans | 29/748 |
| 4,765,044 | 8/1988 | Wilson et al. | 29/749 |

*Primary Examiner*—Daniel Howell

*Attorney, Agent, or Firm*—Louis A. Hecht; Stephen Z. Weiss

[57] ABSTRACT

A modular application tooling machine includes a base unit with a delivery station for electrical connectors, a intermittently operated connector feed drive system and a continuously operated work station drive system. Feed track modules define a connector feed track along which connectors are fed by pusher modules driven by the feed drive system. Work station modules powered on demand by the work station drive system carry out cycles of operation to perform operations on connectors in the feed track. One work station module terminates conductors into insulation displacement terminals of the electrical connectors and another work station module breaks off a carrier strip connected to the terminals.

19 Claims, 14 Drawing Sheets

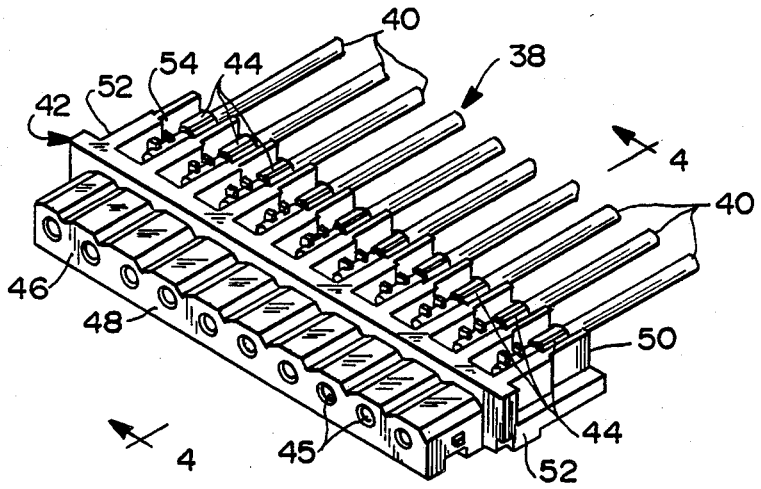
FIG.3
FIG.4
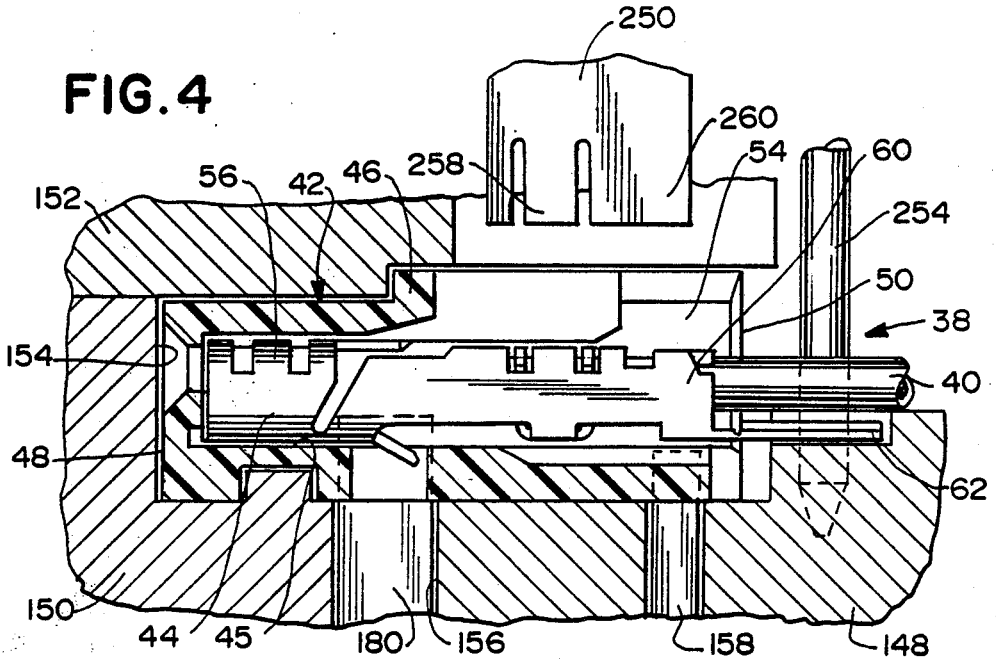

MODULAR APPLICATION TOOLING FOR ELECTRICAL CONNECTORS

FIELD OF THE INVENTION

The present invention relates to application tooling for electrical connectors and more particularly to modular application tooling machines that are versatile and easy to set up for different jobs.

DESCRIPTION OF THE PRIOR ART

Electrical connectors are used in electrical and electronic devices for making electrical connections between various components such as electrical conductors, printed circuit boards and electrical circuit components. Many electrical connectors are of the type including a housing formed of insulating material supporting an array of metal electrical terminals having contact portions engagable with electrical conductors or with other electrical terminals.

Within this general class of electrical connectors are found numerous variations. Conductor engaging contact portions of the electrical terminals may be of the insulation displacement type, the insulation piercing type, the crimp type or others. The centerline spacing between adjacent terminals can vary widely for different connectors. Many different housing shapes and sizes may be used. Housings may be stackable end to end with uniform or nonuniform terminal centerline spacing maintained between adjacent housings.

In manufacturing a given completed connector, one or more of many different operations may be required. Examples of such operations are the insertion of conductors into insulation displacement slots of terminals of a connector, crimping of terminals onto electrical conductors, breaking off of terminal carrier strips, insertion of terminals into a housing, skipping of terminal positions to leave voids in the housing, marking or printing of indicia on connector housings, testing of connections between terminals and electrical conductors and deforming of housings for keying or polarizing purposes.

In order to minimize expense, it is desirable to automate those manufacturing processes concerned with electrical connectors. A class of equipment known as application tooling has been developed for this purpose. In the past, dedicated application tools or application tooling machines have been designed and built for specific types of electrical connectors with the capability of performing the specific operations required for those connectors. The typical approach is to provide a special purpose application tooling machine to make a specific product such as a wiring harness or cable assembly or jumper or the like using a specific type or types of connector. The special purpose machine cannot readily be modified or adapted for other connector types or other operations. The requirement for different special purpose machines for different connector types and products results in inconvenience and expense on the part of manufacturers and users of application tooling machines.

SUMMARY OF THE INVENTION

A principal object of the present invention is to provide an application tooling machine having modular components to the end that the machine may be adapted for different connector types and for different operations that may be required in the manufacture of products such as cable assemblies or harnesses using such connectors. Other objects are to provide application tooling machines with commonality of components used for different purposes; to provide kits of modules that can be used to add work stations to application tooling machines; to provide an application tooling machine that can quickly be modified and set up for different operations and different connectors; to provide an application tooling machine with a base unit that can be associated with selected different modular units in order to feed and to perform different selected operations on electrical connectors; to provide such a base unit with connector feed and work station drive systems readily adaptable to many different connector types; and to overcome disadvantages and avoid expenses encountered with known application tooling.

In brief, the objects and advantages of the present invention are achieved by providing modular application tooling for electrical connectors having a housing and electrical terminals, the tooling including a base unit with a connector feed drive system and a work station drive system. A modular feed track unit includes a track segment defining a feed track extending along a feed path in a feed direction. The base unit includes a connector delivery unit for delivering electrical connectors to the feed track. A modular pusher unit includes a body portion movable in the feed direction. A pawl member is supported by the body portion and is receivable into the feed path for advancing electrical connectors along the feed path. The connector feed drive system includes means for selectively moving the pusher unit in the feed direction. A modular work station unit includes a tooling component movable relative to the feed path. The work station unit includes a drive takeoff system connected between the work station drive system and the tooling component for selectively operating the tooling component.

BRIEF DESCRIPTION OF THE DRAWINGS

The present invention together with the above and other objects and advantages may best be understood from the following detailed description of the embodiment of the invention illustrated in the drawings, wherein:

FIG. 3 is a perspective view of a completed single ended cable assembly made on the machine;

FIG. 4 is an enlarged, fragmentary, cross-sectional view of the cable assembly taken along the line 4—4 of FIG. 3 also including components of the termination station of the machine not seen in FIG. 3;

DETAILED DESCRIPTION OF THE PREFERRED EMBODIMENT

Figure 1:
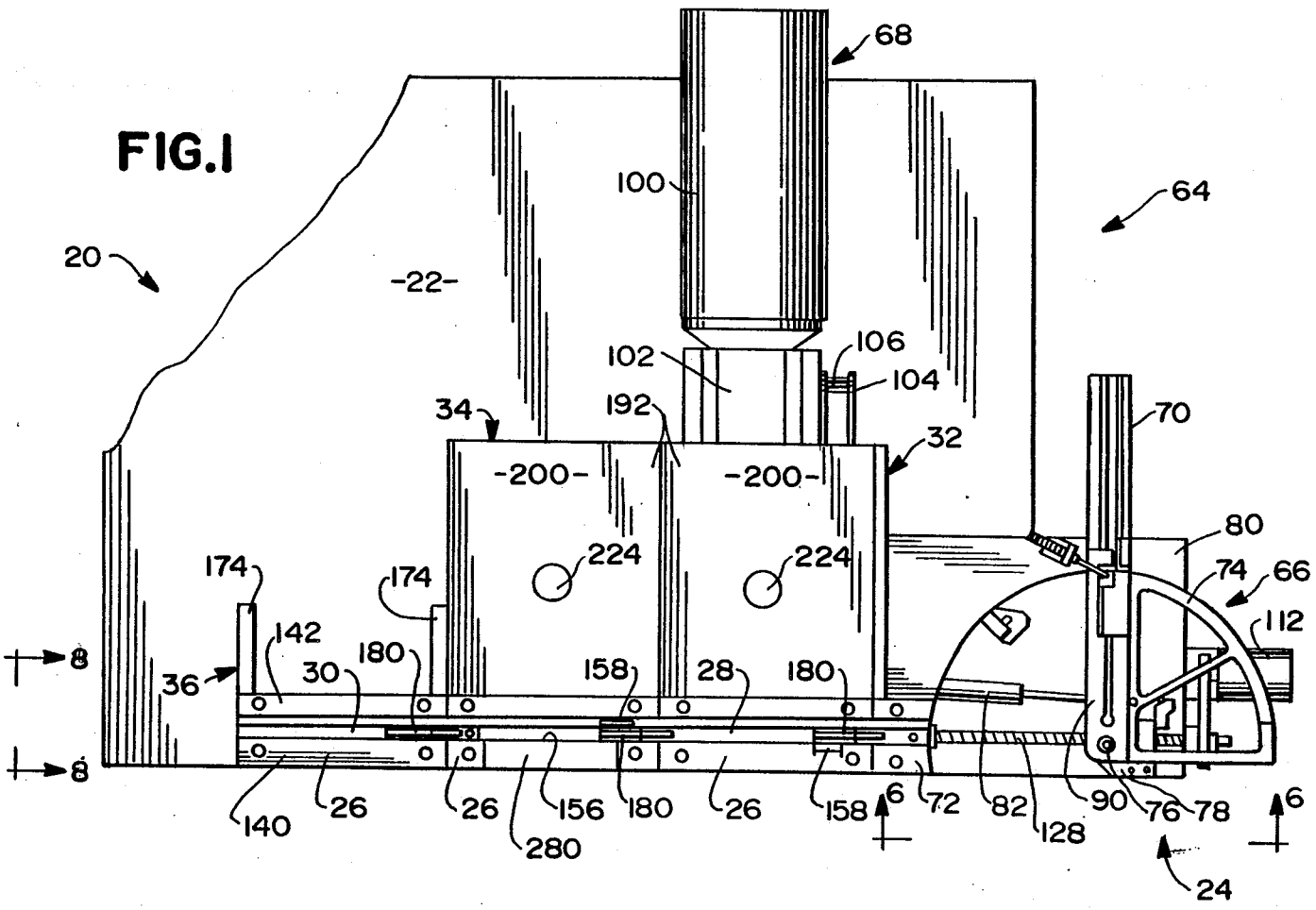
FIG. 1 is a fragmentary top plan view of portions of a modular application tooling machine constructed in accordance with the present invention.

With reference to the drawings, FIG. 1 is a top view of a modular application tooling machine designated as a whole by the reference character 20 and constructed in accordance with the principles of the present invention. In general, the machine 20 includes a support or table 22 on which are supported a connector delivery station 24, a number of connector feed track modules 26, pusher modules 28 and 30, a pair of work station modules that in the illustrated embodiment of the invention are a termination work station module 32 and a carrier strip breakoff work station module 34 and a cable assembly delivery station 36.

Cable Assembly

Because of its modular nature, the machine 20 is extremely versatile and can perform many types of work operations on electrical connectors of many different types. The illustrated machine functions in repeating cycles of operation to manufacture single ended cable assemblies such as the assembly 38 seen in FIGS. 3 and 4. Assembly 38 includes a number of discrete electrical conductors 40 and an electrical connector 42. Each conductor 40 includes a conductive wire surrounded by a layer of insulation. Each conductor 40 is electrically and mechanically connected to one of a number of electrical terminals 44 contained in cavities 45 of a housing 46.

Housing 46 is a unitary body molded of plastic and includes a front wall 48, a rear wall 50 and opposed end walls 52. Cavities 45 extend between the front and rear walls 48 and 50 side by side in a line between the end walls 52. Each cavity 45 includes an open top portion 54 through which a conductor 40 is inserted for connection to a terminal 44.

Each terminal 44 is stamped and formed of sheet metal stock and includes a forward contact portion 56 to mate with a contact pin or post received through the forward end of cavity 45. The rear segment of the terminal 44 includes a pair of plates 58 having insulation displacement slots 59 and a crimped strain relief portion 60. The termination work station module 32 serves to insert conductors through open top portions 54 so that the insulation layer of the conductor is displaced and metal to metal contact is made with the metal wire in the slots 58. At the same time, the portion 60 is crimped around the insulating layer of the conductor firmly to hold the terminal 44 and the conductor together.

As supplied to the machine 20, the terminals 44 of each connector are integrally joined at their rear portions to a carrier strip 62. To obtain close contact spacing, the carrier strip has double layers superimposed on one another and each layer is connected to alternate terminals 44 along the length of the connector 42. Carrier strip 62 is used for accurate positioning during operation of the termination module 32 but must be removed from the connector 42 after termination. The carrier strip breakoff work station module 34 performs this function during operation of the machine 20.

The machine 20 includes work station modules 32 and 34 specific to the termination and carrier strip breakoff operation required in manufacture of the cable assembly 38. Because of its modular nature, work station modules can be substituted or added to perform operations of many types on many types of electrical connectors. Double ended cable assemblies may be manufactured by duplicating the components of the machine 20 in a mirror image orientation and performing work operations on electrical connectors at both ends of conductors 40. Appropriate work station modules with corresponding feed track and pusher modules may be assembled with the machine 20 for terminating crimp, insulation displacement or insulation piercing terminals with discrete wire, ribbon cable or flat flex cable. Conductors may be mass terminated or terminated one at a time as with the cable assembly 38. Work station modules may be used for other types of operations such as testing completed terminations with electrical probes, seating partially loaded terminals fully into connector housings, providing connectors with keying or polarizing features and marking connectors with printing, hot stamping labelling or the like.

Base Unit

Referring to FIG. 1, the machine 20 includes a base unit 64 with which selected different work station modules, feed track modules 26 and pusher modules 28 and 30 may be associated to provide a machine for a specific selected series of electrical connector product manufacturing operations. Base unit 64 includes the table 22 and associated frame elements, the connector delivery system 24, a connector feed drive system 66 and a work station drive system 68.

Figure 5:
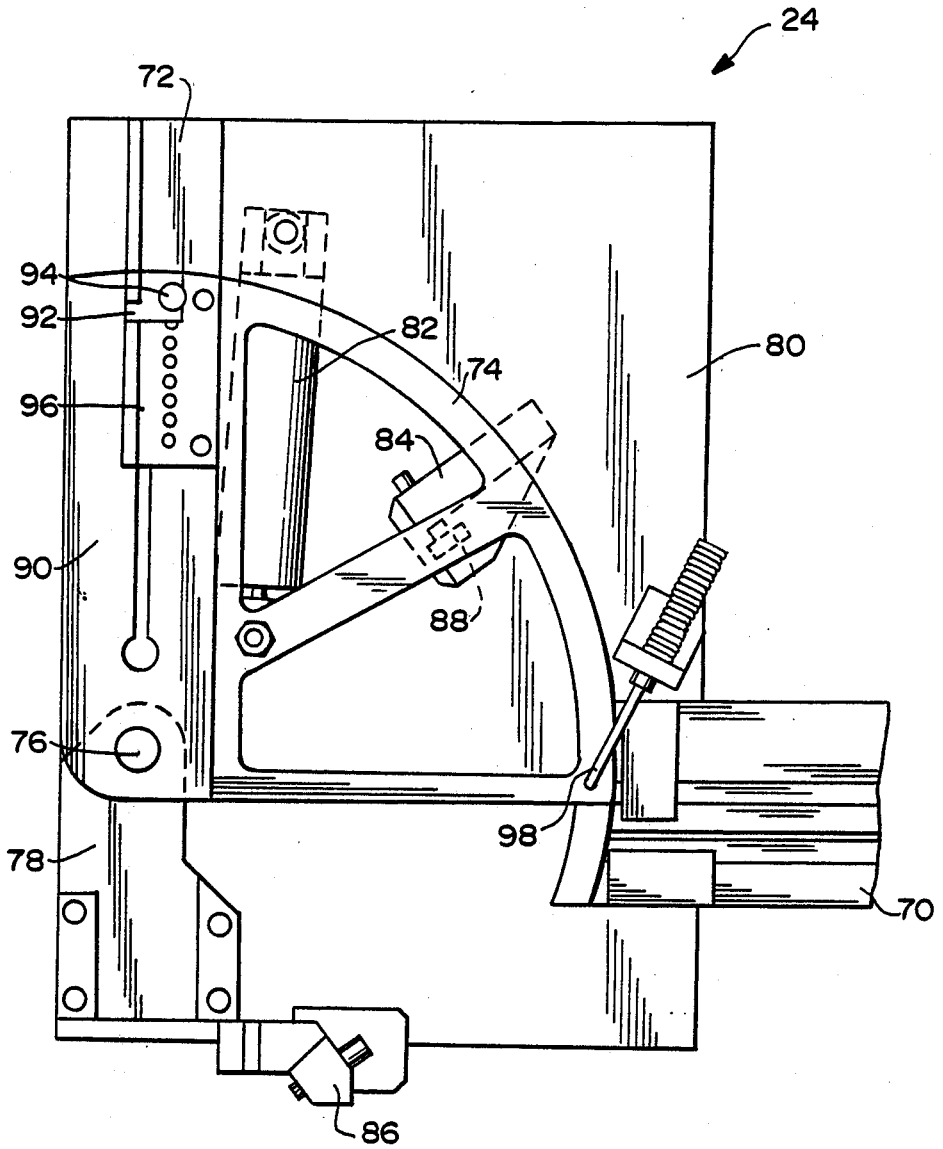
FIG. 5 is an enlarged fragmentary top view of the connector delivery station of the machine.

Connector delivery station 24 (FIGS. 1 and 5) receives connectors 42 one at a time from a connector supply track 70 and places individual connectors in position to be fed by pusher module 28 through an entry track 72 to the connector feed track modules 26. A generally quadrant shaped delivery frame 74 is pivotally mounted on a pin 76 supported on a bracket 78 in turn supported on a shelf 80 mounted in a fixed position relative to the table 22. An air cylinder 82 connected between the shelf 80 and the delivery frame 74 pivots the frame 74 through about ninety degrees of rotation between a connector receiving position seen in FIG. 1 and a connector delivery position seen in FIG. 5. A pair of sensing switches 84 and 86 are engaged by a contactor 88 carried by the frame 74 to provide indications when the delivery frame 74 reaches its alternative positions. Preferably the active machine components such as cylinder 82 are controlled by a microprocessor based controller responsive to program instructions and user selected inputs and inputs provided by detecting devices such as switches 84 and 86.

Connector supply track 70 extends away from the delivery station 24 and is shaped to slidably receive connectors 42 in end to end relationship. For example, the track 70 may be similar in cross section to the upper portion of the feed track modules 26 described below. Connectors 42 are introduced into the track 70 in any desired way such as manually or with cartridge or tape delivery systems or the like. Connectors in track 70 are urged toward the delivery station 24 by a suitable biasing arrangement.

The connector delivery frame 74 includes a track segment 90 shaped to slidably receive connectors 42. For example, the track segment 90 may be similar in cross sectional shape to the connector feed track modules 26 described below. However, the track segment 90 is preferably machined from one element rather than including the discrete components of the feed track modules.

When the delivery frame 74 is in the connector receiving position (FIG. 1) one connector 42 moves from the supply track 70 to the track segment 90 against a stop 92. Stop 92 is positioned so that a single connector 42 moves from the supply track 70 and the next adjacent connector remains in the supply track as the delivery frame 74 pivots from the connector receiving position. A thumb screw 94 extends through a slot (not seen) in stop 92 and into a selected threaded hole in a plate 96 in order to clamp the stop 92 in a continuously variable position corresponding to the length of the connector housing 46 between its end walls 52. Connectors of different lengths and having different numbers of cavities 45 and terminals 44 may be accommodated.

When a connector 42 is fully seated in the track segment 90, a signal is provided by an optical sensing system including a fiber optic light emitter 98. The delivery frame 74 then moves from the connector receiving position to the connector delivery position seen in FIG. 5 where the track segment 90 is aligned with the entry track 72 leading to the feed track modules 26. The entry track 72 is the same in cross section as and may include components similar in cross section to the feed track modules 26 described below. Pusher module 26 feeds the delivered connector out of the track segment 90 and through the entry track 72 toward the work station modules 24 and 26.

The work station drive system 68 includes a drive motor 100 and gear reduction unit 102 for rotating a drive pulley 104 (FIG. 1). A drive belt 106 transfers rotation to a driven pulley 108 disposed within the termination module 32 (FIG. 2) and supported by a bearing assembly 110. The drive motor 100 is operated continuously during operation of the machine 20 so that power is continuously available on demand for operation of the work station modules 32 and 34.

Figure 6:
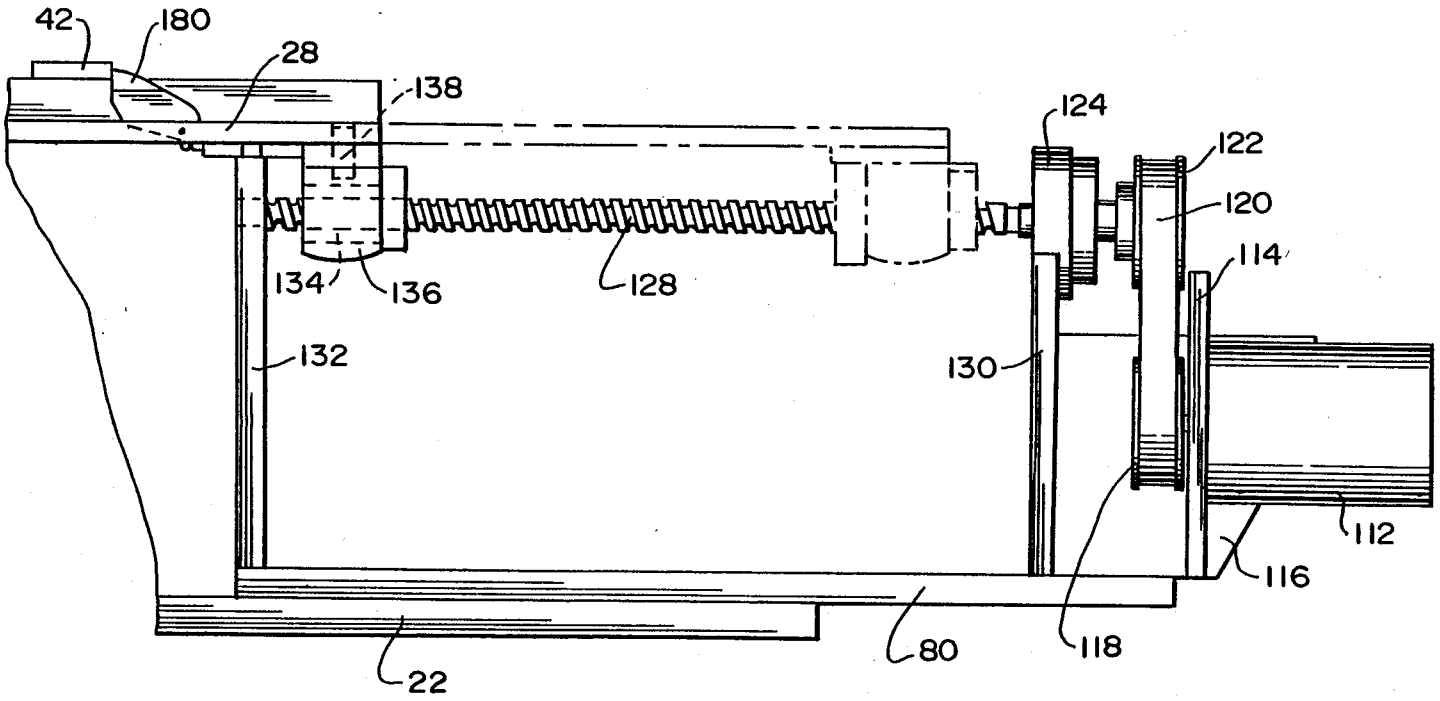
FIG. 6 is a fragmentary view taken from the line 6—6 of FIG. 1 with other structure omitted in order to show the connector feed drive system of the machine.
Figure 7:
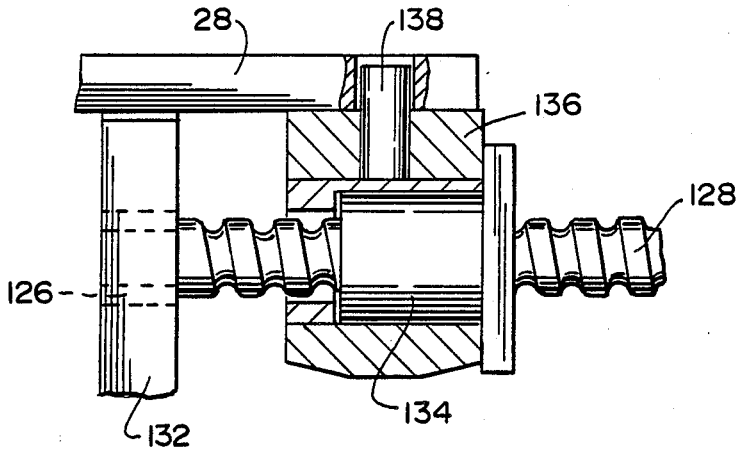
FIG. 7 is an enlarged fragmentary sectional view of part of the connector feed drive system of FIG. 6.

The connector feed drive system illustrated in FIGS. 6 and 7 controls the feeding of connectors 42 to selected, accurately indexed positions along the feed track modules 26. Connectors may be fed with great accuracy from work station to workstation, or may be fed any desired terminal centerline spacing distance within any work station. This drive system includes a drive motor 112 carried by a plate 114 supported on a bracket 116 above the shelf 80. A drive pulley 118 is coupled by a toothed belt 120 to a driven pulley 122. A bearing assembly 124 and a bearing 126 support a worm gear or threaded shaft 128 between a pair of housing walls 130 and 132. The driven pulley is mounted at one end of shaft 128 and a ball nut 134 in a housing 136 is engaged with the shaft 128. Housing 136 carries a drive pin 138 for making a drive connection to the pusher module 28.

The connector feed drive motor 112 is operated intermittently for feeding connectors 42 and is of a type that can be accurately controlled to provide a desired displacement. A digitally controlled stepper motor is preferred. A motor with optically encoded feedback control may also be used. Used in combination with the shaft 128 and ball nut 134, the motor 112 is capable of positioning a connector 42 in any precise position along the feed track modules 26. With this arrangement the exact position of a connector is determined by the magnitude of motor energization, for example, the number of steps for a stepper motor.

Connector Feed Track Modules

One connector feed track module 26 is associated with each work station module 32 and 34 and one is associated with the cable assembly delivery station 36. The standard modular length of each feed track module is equal to the standard modular width of the work station modules. Work station modules may be added or taken from the machine 20 along with the corresponding feed track modules as desired for specific manufacturing processes.

Figure 8:
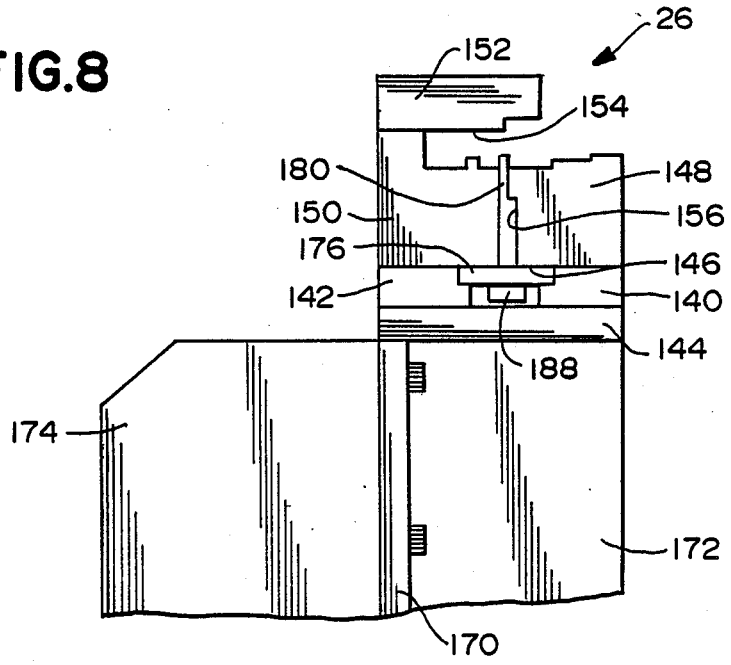
FIG. 8 is a fragmentary end view of the feed track portion of the machine taken from the line 8—8 of FIG. 1.

A standard feed track module 26 includes standardized components seen in profile in FIG. 8. A front pusher guide 140 and a rear pusher guide 142 are supported on a shelf element 144. The inner edges of guides 142 and 144 are profiled to define a pusher track 146 that extends from a similar track in track segment 90 to the connector exit or downstream end of the cable assembly delivery station 36.

A front track member 148 and a rear track member 150 are supported on the guides 142 and 144 and a track cover 152 is supported on the rear track member 150. The track cover 152 and the upper surfaces of the track members 148 and 150 are profiled to match the profile of the connector 42 and define a connector feed track 154 along which connectors slide from the delivery station 24 to the exit end of the cable assembly delivery station 36. The inner surfaces of the track members 148 and 150 are profiled and spaced apart to define a pawl slot 156 extending vertically from the pusher track 146 to the feed track 154 and extending horizontally along the full length of the tracks 146 and 154.

The track cover 152 and the track members 148 and 150 are omitted from FIG. 1 in order to render other portions of the structure visible. The components of the feed track modules 26 are held in assembly by screws located at desired places and extending into the shelf elements 144. While the feed track module components are standard parts, certain ones of them may be modified to permit certain functions to be performed by associated work station modules. In addition, either the front or rear track member of the feed track modules 26 associated with the work station modules 32 and 34 is provided with an anti backup pawl 158 (FIG. 1) to prevent connectors 42 from being moved along the feed track 154 in the reverse direction back toward the delivery station 24.

Figure 11:
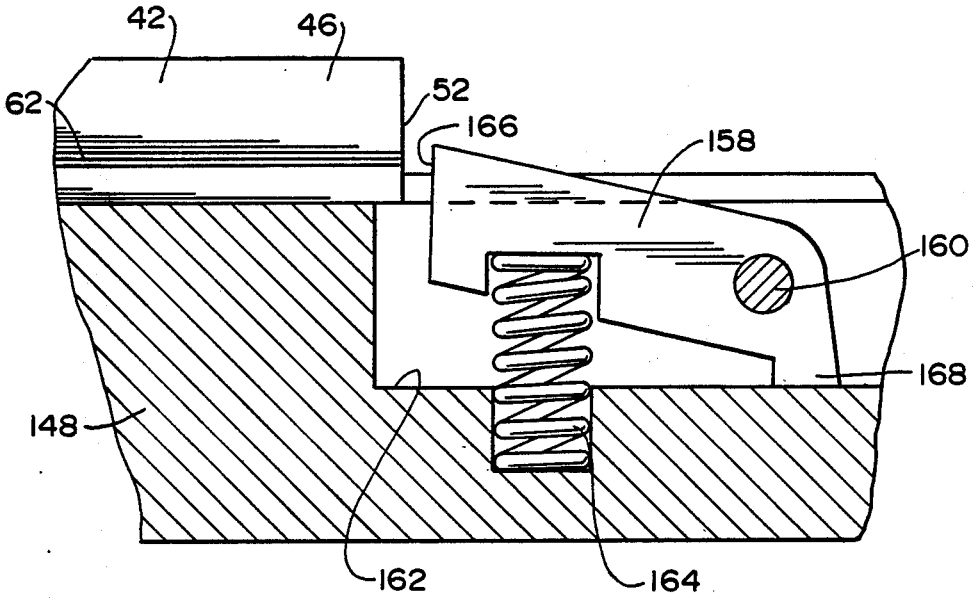
FIG. 11 is a greatly enlarged sectional view illustrating an anti backup pawl of the machine.

The anti backup pawl 158 associated with the termination work station module 32 is shown in FIG. 11. The pawl is pivoted on a pin 160 within a recess 162 formed in track member 148. A spring 164 biases a tip 166 of the pawl into the feed track 154. This position is determined by engagement of a stop leg 168 with a wall of the recess 162. When a connector 42 is fed in the forward or downstream direction away from the delivery station 24, the pawl is pivoted out of the feed track 154. Movement in the reverse direction is prevented by engagement of the tip 166 against the connector 42.

The shelf elements 144 are supported above the table 22 by a rear wall 170 and a pair of gussets 172. In the case of the feed track modules 26 associated with the work station modules 32 and 34, the rear wall 170 are attached to the fronts of the work station modules. In the case of the cable assembly delivery station 36, the front wall is supported with respect to the table 22 by a pair of support walls 174. The cable assembly delivery station 36 is provided to receive completed cable assemblies 38 as their manufacture is completed.

Pusher Modules

Figure 9:
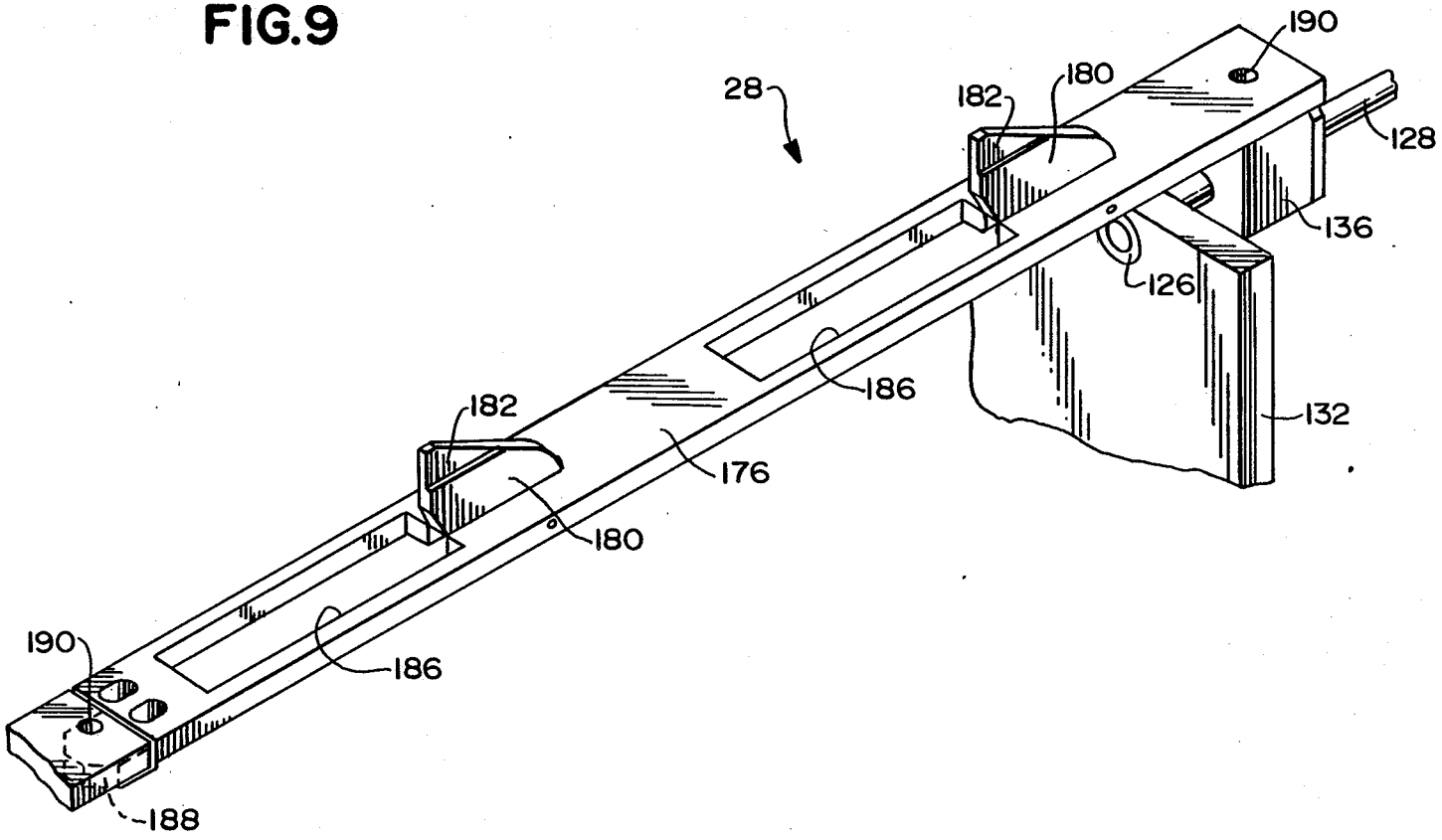
FIG. 9 is a perspective view of one pusher module of the machine of FIG. 1.
Figure 10:
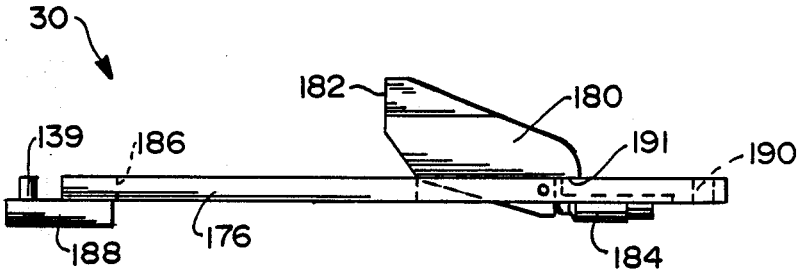
FIG. 10 is a side view of another pusher module of the machine.

Pusher modules 28 and 30 are precisely moved in the pusher track 146 by the feed drive system 66 and engage conductors 42 in the feed track 154 in order to precisely position the connectors 42 relative to the work station modules 32 and 34. Two different types of pusher modules 28 and 30 are used in the machine 20. Module 28 as seen in FIG. 9 includes a pusher body 176 shaped to slide in the pusher track 146. Body 176 supports two pusher pawls 180 at regularly spaced intervals. Module 30 as seen in FIG. 10 includes a shorter pusher body 176 supporting a single pawl 180. Module 28 is equivalent in length to two feed track modules 26 and can feed connectors 42 to two adjacent work stations. Module 30 is equivalent in length to a single feed track module and can feed connectors to a single work station. In other respects the modules 28 and 30 are similar to each other and include identical elements.

Each pawl 180 is pivoted in a pusher body 176 and includes a tip portion 182 of decreased thickness engagable with a connector 42 in the feed track 154. The tip is normally biased upward by a spring cartridge 184 (FIG. 10) and is pivoted down by contact with a connector 42 when the pusher module is retracted in the reverse direction along the pusher track 146. Each pawl 180 is adjacent an opening 186 formed in the pusher body 176. Openings 186 are provided so that tooling components operated by work station modules can reach the undersides of connectors 42 in the feed track 154 if desired.

Pusher modules 28 and 30 are coupled together and to the ball nut housing 136 of the feed drive system 66 in a train like array or string slidably movable in the pusher track 146. Coupling is accomplished by a drive pin 139 carried by a stepped extension 188 at the front end of each pusher body 176 and by mating holes 190 at the rear end. Pawls 180 are received in the pawl slot 156, and upward pawl movement is limited by engagement of a stop surface 191 with the upper surface of the pusher body 176.

Work Station Modules

Work station modules 32 and 34 of the machine are examples of a wide variety of different modules that may be employed for performing various operations on various types of electrical connectors. The work station modules each include some elements that are common to all similar modules and some elements that are specific to a particular module used for a specific connector or a specific function. Those components that are generally common to different modules include a housing 192 with a base 194 and a drive takeoff system 196.

Figure 2:
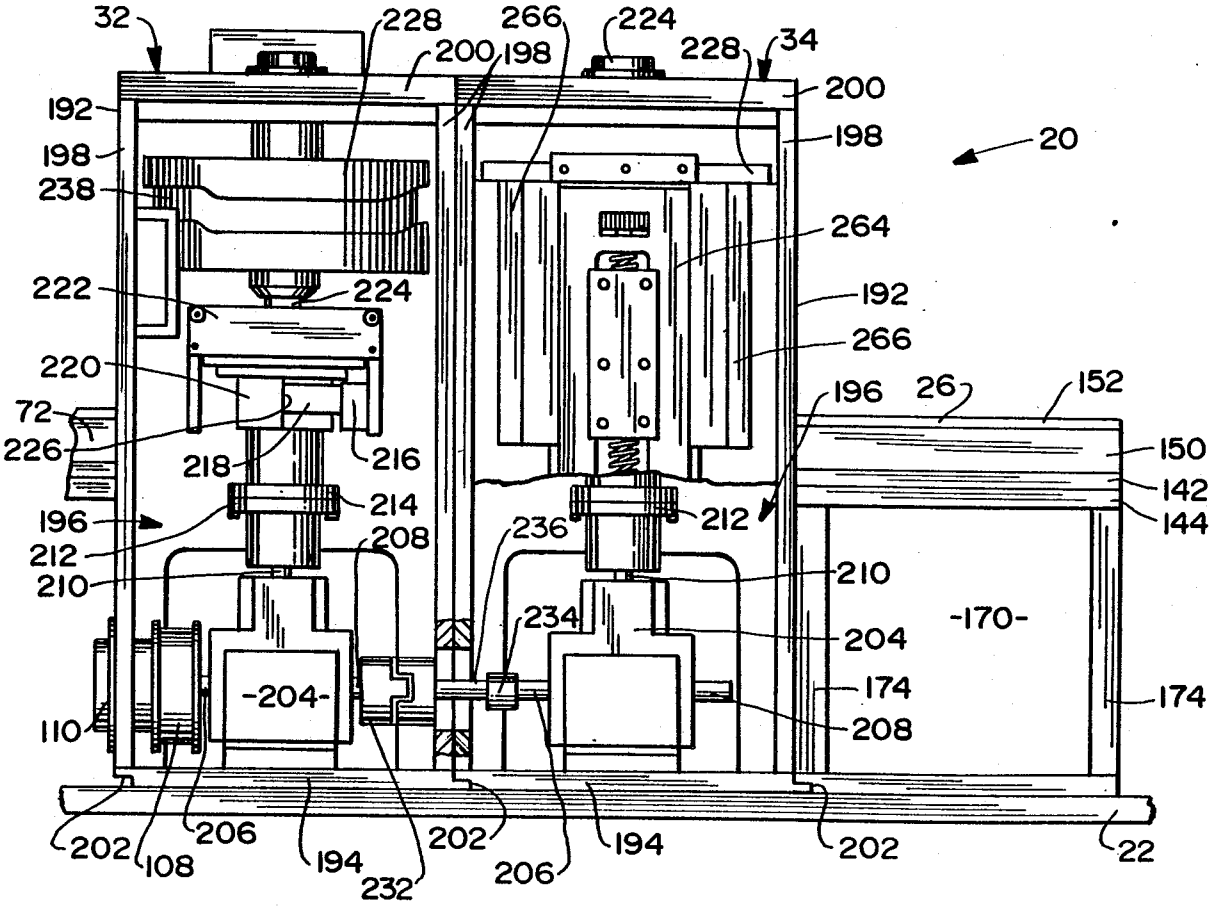
FIG. 2 is a fragmentary rear view of the machine showing the termination and carrier strip breakoff work stations.

In FIG. 2 it can be seen that each module housing 192 includes side and top walls 198 and 200 as well as base wall 194. The side edges 202 of the base 194 have a stepped shape so that adjacent work station modules interfit with one another. During set up of a machine with a number of modules, this assists in aligning the modules and assuring that they are oriented correctly on the table 22.

The drive takeoff systems 196 operate on demand to carry out one cycle of work station operation powered by the continuously operating work station drive motor 100. The drive takeoff systems 196 are similar to one another and are best seen in FIG. 2. In each module, a miter gear assembly 204 is supported above the base wall 194. Assembly 204 includes horizontal shaft segments 206 and 208 and a vertical shaft 210 extending upward between side walls 198. Shafts 206, 208 and 210 are connected together for simultaneous rotation. Shafts 206 and 208 serve as a drive extension for coupling rotary drive power latterally through the work station modules for powering one or more adjacent work station modules.

Vertical shaft 210 is connected by an overload shear coupling 212 to a single revolution clutch and brake assembly 214 controlled by an actuator 216 and actuator arm 218 engaging a control collar 220 of the clutch and brake assembly. Assembly 214 is preferably a Model CB-6 wrap spring clutch and brake assembly available from Warner Electric Clutch and Brake Company or a similar unit such as disclosed in U.S. Pat. No. 3,987,947 incorporated here by reference. Assembly 214 is mounted on a support bracket 222. While shaft 210 continuously rotates, an output shaft 224 of assembly 214 is normally held stationary by engagement of arm 218 with a lug 226 on collar 220. When actuator 216 momentarily lifts arm 218 from collar 220, shaft 224 rotates together with shaft 210 for one revolution or three hundred sixty degrees of rotation. At the end of one revolution, lug 226 is stopped by arm 218 and the clutch and brake assembly 214 is operated to hold shaft 224 stationary. An operating cam 228 is connected to shaft 224 and is journalled for rotation in top wall 200.

The upstream one of the work station modules, in this case the termination work station module 32, contains the driven pulley 108 of the work station drive system 68. Pulley 108 is mounted to shaft 206 of module 32. Shaft 208 of the termination module 32 is coupled to shaft 206 of the breakoff module 34 by a pair of couplings 232 and 234 and by an extension shaft 236. In a similar manner other work station modules may be coupled together as desired. Because all shafts 206, 208 and 210 of the work station modules rotate continuously, a full rotation of any module operating cam can be carried out at any time under program control by momentary actuation of the selected actuator 216. The nature of the work operation performed by any module is determined by components specific to that module.

Termination Module

Figure 12:
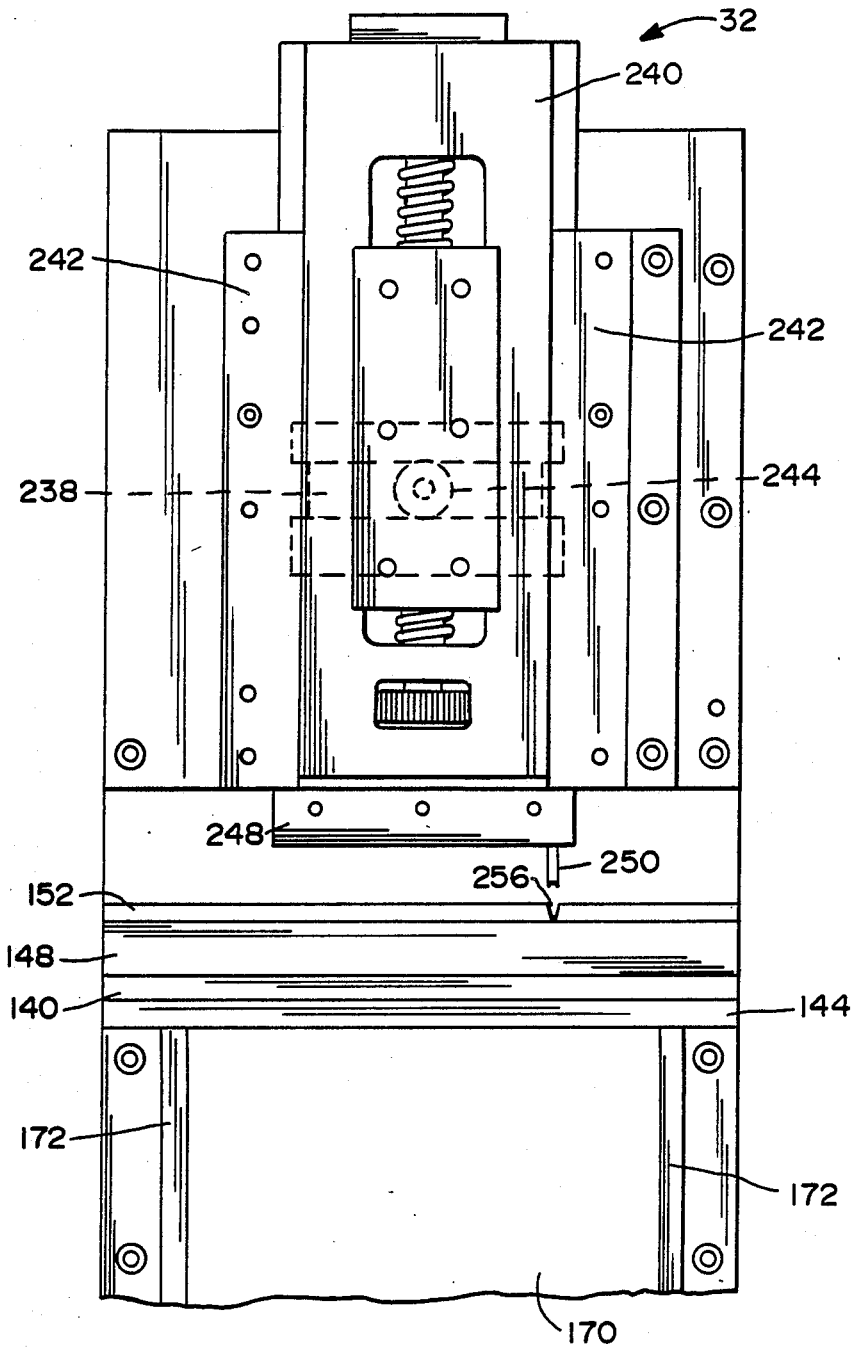
FIG. 12 is a front view of the termination work station module of the machine.
Figure 13:
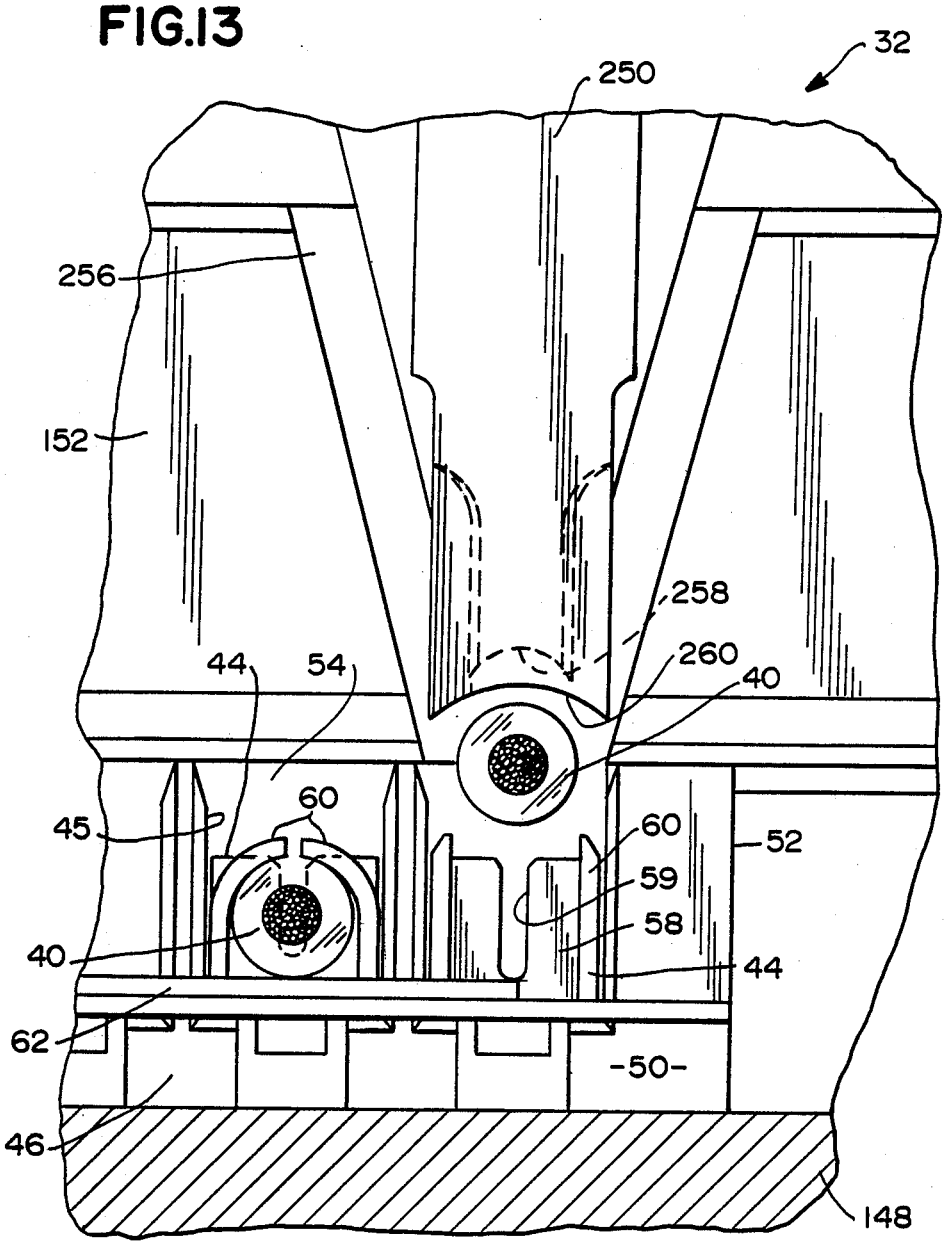
FIG. 13 is a greatly enlarged fragmentary front view, partly in section, illustrating part of the termination station of the machine.
Figure 14:
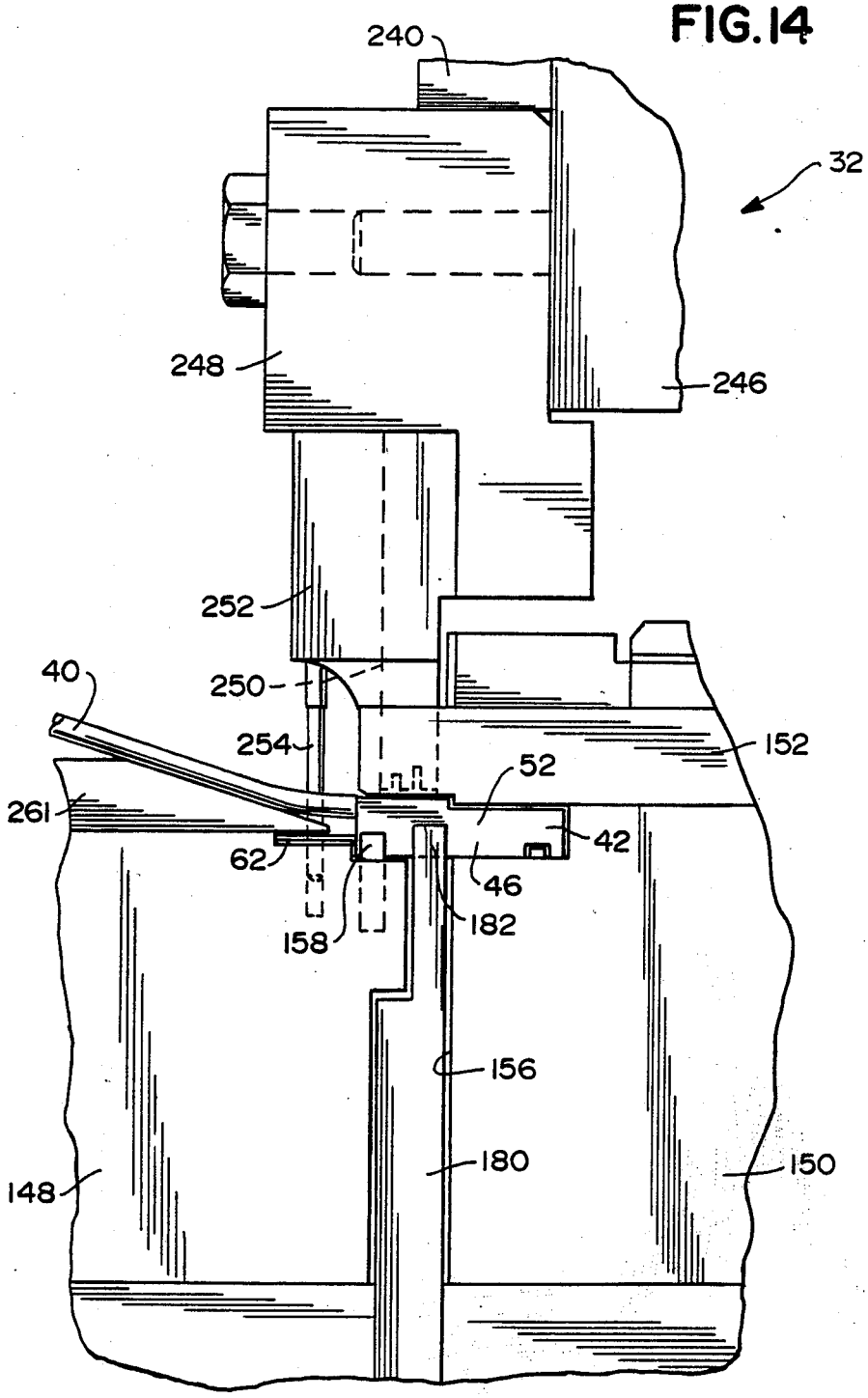
FIG. 14 is an enlarged side elevational view of portions of the termination work station of the machine.

Components specific to the termination work station module 32 operate to terminate one conductor 40 to the insulation displacement slots 58 and crimp portion 60 of one terminal 44 in each work cycle. The module 32 is illustrated in FIGS. 12–14 as well as in FIG. 2. Cam 228 includes a single excursion cam track 238. A slide assembly 240 is supported for vertical movement between slide tracks 242 on the front of the module housing 192 and carries a cam follower 244 riding in cam track 238. As seen in FIG. 14, the slide assembly 240 includes a tooling mount 246 to which a blade mounting block 248 is attached. Tooling components in the form of an insertion blade 250 and pilot pin 254 are specific to the module 32. The insertion blade 250 is held by a blade clamp 252 and extends down toward the connector feed track 154. The pilot pin 254 (FIGS. 3 and 14) also extends down from slide assembly 240.

Below the insertion blade 250, the track cover 152 of the connector feed module is provided with a V shaped wire guide slot 256 (FIGS. 12 and 13). Before a conductor is terminated by the module 32, a conductor 40 is placed into this slot either manually or if desired by wire feeding equipment. If desired, a detecting device (not shown) may be used to initiate a termination work cycle when a conductor 40 is in place.

During the single revolution of cam 228, the slide assembly 240 moves down in a termination stroke followed by an upward return stroke. As the assembly moves down, the pilot pin 254 enters one of a series of pilot holes in the carrier strips 62 and moves down into a clearance passage in the front track member 148. This accurately positions the termination blade in registration with a conductor in slot 256 and with one terminal 44 as shown in FIG. 13. The blade includes a rear insertion portion 258 for pushing conductor 40 into slots 58 and a forward crimping portion 260 for closing the strain relief portion 60 of terminal 44 onto the insulation layer of the conductor 40 as seen in FIG. 13. A retainer 261 (FIG. 14) overlies the carrier strip 62 to hold it in place as the pilot pin 254 and insertion blade 250 retract.

Carrier Strip Breakoff Module

Figure 15:
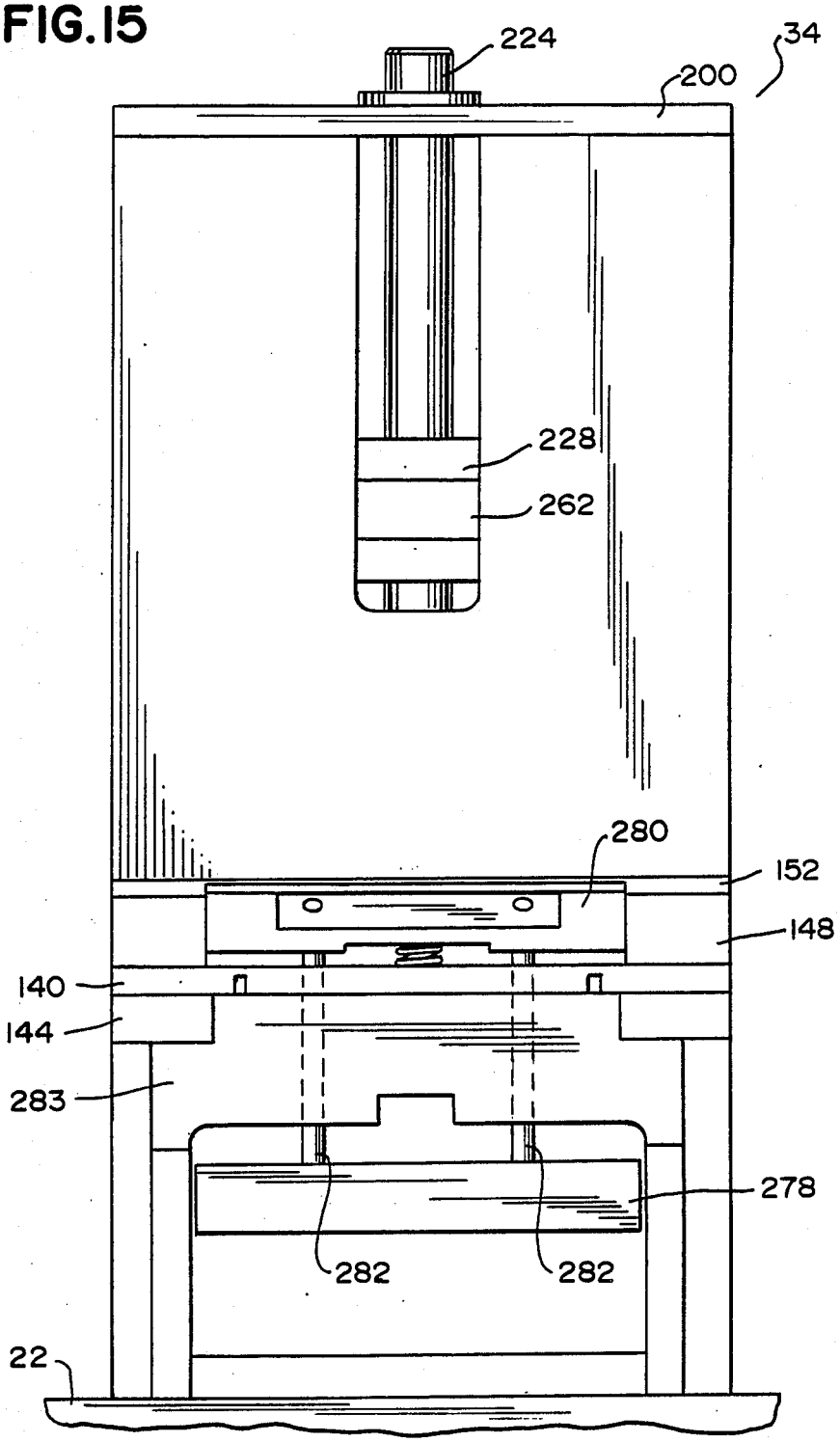
FIG. 15 is a front view of the carrier strip breakoff work station of the machine.
Figure 16:
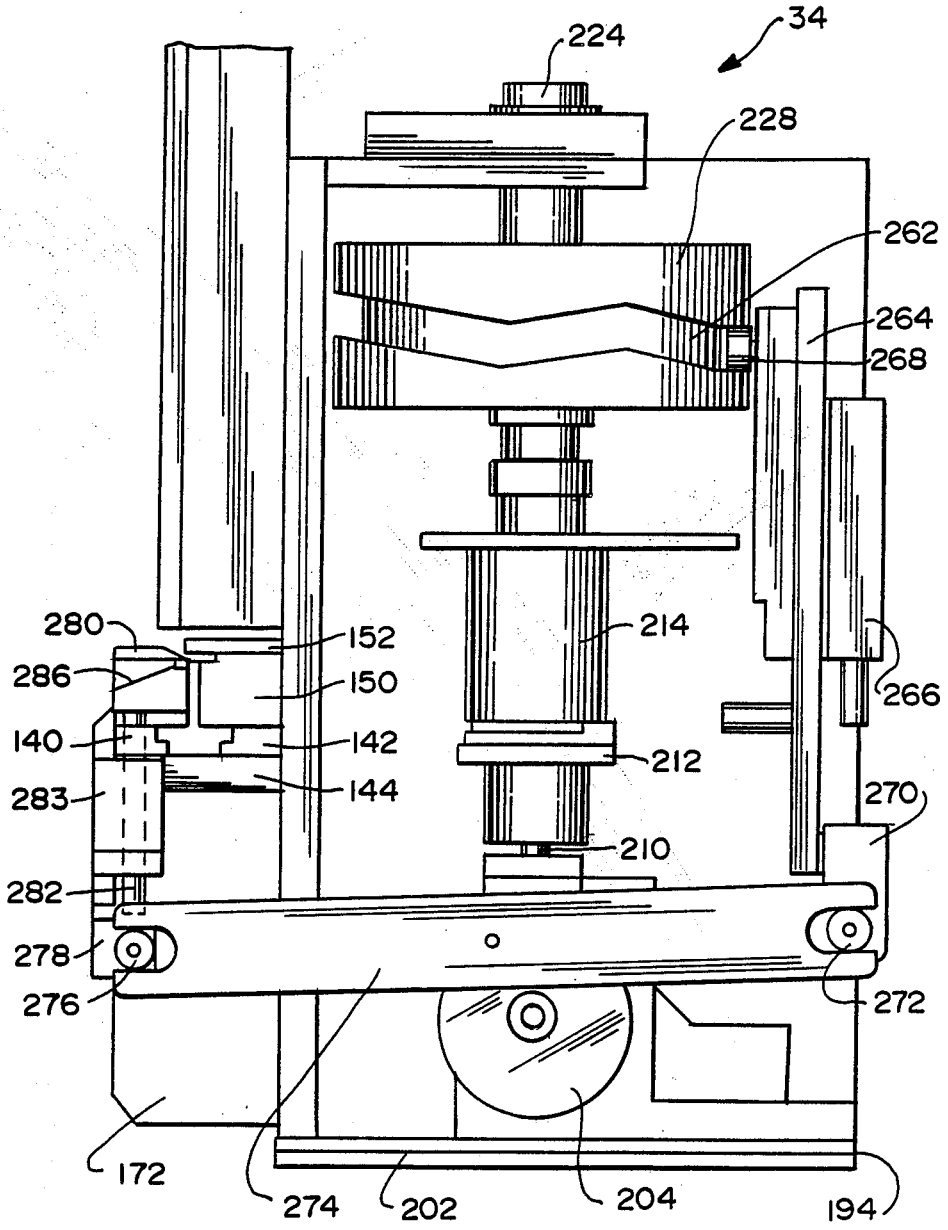
FIG. 16 is a simplified, diagrammatic side view, with portions omitted for clarity, of the carrier strip breakoff work station of the machine.
Figure 17:
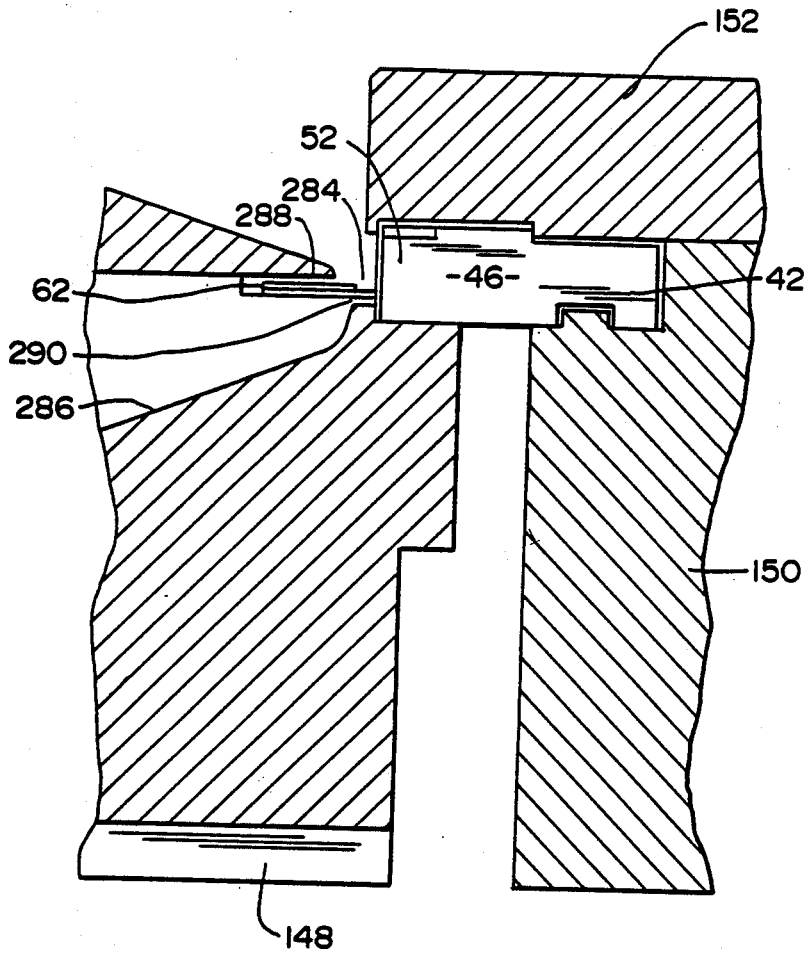
FIG. 17 is a greatly enlarged sectional view of parts of the carrier strip breakoff work station of the machine.

The carrier strip breakoff work station module 34 fractures the carrier strip from the terminals 44 of a connector 42 during each cycle of operation of the module 34. Module 34 is illustrated in FIGS. 15–17 and in FIG. 2. Cam 228 of the module 34 includes a multiple excursion cam track 262. A slide assembly 264 is mounted for vertical movement between slide tracks 266 at the rear of the module 34. Assemblies 240 and 264 may use common, inverted parts. Slide assembly 264 supports a cam follower 268 riding in cam track 262. A tooling mount 270 carries a roller 272 received in a slot in one end of a rocker arm 274 pivoted to one side wall 198 of the module. The other end of the arm 274 has a slot receiving a roller 276 carried by a reciprocating block 278 located at the front of the module 34. The mechanism including arm 274 and rollers 272 and 276 is duplicated at both sides of the module 34.

A segment of the front track member 148 of the feed track module 26 is removed adjacent the breakoff module to receive a tooling component in the form of a breakoff block 280. Block 280 is connected to block 278 by a pair of rods 282 supported for vertical sliding movement in a support bracket 283. Breakoff block 280 includes a cavity defining an elongated mouth or slot 284 at the front of the feed track 154 and a scrap discharge ramp 286 extending downward and forward from the mouth 284. Normally the block 280 is positioned as seen in FIG. 17.

When a connector 42 is positioned in the feed track 154 adjacent the breakoff module 34, the carrier strip 62 is received in the mouth 284. When the module 34 is operated, a single rotation of the cam 228 results in repeated up and down movements of the breakoff block 280 in response to reciprocation of slide assembly 264 and block 278 coupled by rocker arms 274. During these movements an upper surface 288 and a lower surface 290 (FIG. 17) adjacent the mouth 284 alternately bend the carrier strip 62 down and up so that fatigue of the metal causes the carrier strip to fracture and fall down the ramp 286.

Operation

Before operating the machine 20, the appropriate work station modules are selected in accordance with the type of electrical connector to be processed and in accordance with the operations to be performed by the machine. These modules are oriented and mounted on the table 22. One module is connected to the work station drive system 68 using driven pulley 108, and the modules are interconnected with shafts 236 and couplings 232 and 234. The cable assembly delivery station is mounted at the downstream end of the series of work station modules. Feed track modules 26 and pusher modules 28 and/or 30 are also selected and installed. The feed track modules, together with tracks 70 and 72 and track segment 90 may be tailored to particular connector shapes and sizes, and the track components may be modified to permit access by the specific tooling components of the selected work station modules. Set up time or change over time for different products is much shorter than is required with existing application tooling machines.

When the machine 20 has been set up in the configuration illustrated in the drawings, a supply of connectors 42 is placed in the supply track 70. The stop 92 is adjusted for the length of the connectors 42. The work station drive motor 100 is operated continuously for on demand power to the work station modules 32 and 34. The delivery frame is moved to the connector receiving position shown in FIG. 1 and a single connector is received in track segment 90. The delivery frame 74 is pivoted by cylinder 82 to its alternate position with track segment 90 aligned with the connector feed track 154.

The connector feed drive system 66 is operated to retract the ball nut housing 136 and the pusher modules 28 and 30 fully in the upstream direction. The upstream pawl 180 engages the connector 42 in the track segment 90. Feed drive motor 112 is operated a controlled amount to advance the connector from the track segment 90 and along the feed track 154 until the first cavity 45 of the connector 42 is aligned with the insertion blade 250 at the termination module. The feed drive motor is stopped to stop the connector 42 at this location and a conductor 40 is placed into the wire guide slot 256. The termination module 32 is operated for one cycle to position the connector with pilot pin 254 and to terminate the conductor 40 into terminal 44.

The connector feed drive system is again operated to advance the next cavity 45 of connector 42 into the termination position. The connector is stopped and another cycle of operation of the termination module takes place. This sequence of operation is repeated until all of the terminals 44 of the connector 42 have been terminated. Cavities 45 of the connector 42 may be skipped if the cable assembly 38 includes voids.

The delivery frame is cycled between positions to advance a second connector from the supply track 70 into alignment with the connector feed track 154. The pusher modules 28 and 30 together with the pawls 180 are again retracted fully upstream. The terminated connector adjacent the termination module 32 is held against reverse movement by the anti backup pawl 158 located at that module. When the feed drive system is operated to advance the second connector 42 to the termination module 32, the downstream pawl 180 of the pusher module 28 simultaneously advances the first connector 42 along the feed track 154 to the carrier strip breakoff work station module 34.

The second connector is terminated with conductors in a series of cycles of operation of the termination module. At some point before the pusher modules 28 and 30 are retracted for delivery of a third connector 42, the breakoff module is operated in a single cycle of operation to remove the carrier strip 62 from the first connector 42 by repeated movements of the breakoff block 280.

When a third connector is advanced to the termination module 32, the second connector is advanced to the breakoff module 34 and the completed cable assembly 38 including the first connector 42 is advanced by the pawl 180 of the pusher module 30 to the cable assembly delivery station 36. These interrelated operations are repeated to continue to supply completed cable assemblies 38 to the delivery station 36.

While the invention has been described with reference to details of the illustrated embodiment, these details are not intended to limit the scope of the invention as defined in the appended claims.

We claim:

1. Modular application tooling for electrical connectors each having a housing and electrical terminals, said tooling comprising:

a base unit including a connector feed drive system and a work station drive system;

at least one modular feed track unit including a track segment defining a feed track extending along a feed path in a feed direction;

said base unit including a connector delivery unit for delivering electrical connectors to said feed track;

at least one modular pusher unit including a body portion movable in said feed direction and including a pawl member supported by said body portion and receivable into said feed path for advancing electrical connectors along said feed path;

said connector feed drive system including means for selectively moving said pusher unit in said feed direction; and at least one modular work station including a tooling component movable relative to said feed path;

said work station unit including a drive takeoff system connected between said work station drive system comprising a continuously operated work station drive motor and said tooling component for selectively operating said tooling component.

2. Modular application tooling as claimed in claim 1, said drive takeoff system including a single revolution clutch connected between said work station drive motor and said tooling component.

3. Modular application tooling as claimed in claim 2, said drive takeoff system further including a cam and cam follower connected between said clutch and said tooling component.

4. A kit as claimed in claim 1, said feed track module and said pusher module having corresponding lengths, and said work station module having a width corresponding to said lengths.

5. A kit of modular components for adding a work station to an electrical connector application tooling machine, said kit comprising:

a connector feed track module including a feed track structure defining an electrical connector feed path and end coupling portions mating with end coupling portions of similar feed track modules;

a pusher module including a body portion slidable with respect to feed track module in a feed direction parallel with said connector feed path and including a pawl supported by said body portion and extending into said connector feed path; and a work station module including a tooling component movable with respect to said electrical connector feed path and a tooling component drive system for moving said tooling component.

6. A kit as claimed in claim 5, said feed track module defining a pusher track slidably receiving said pusher body portion and a pawl slot extending between said pusher track and said feed path, and said pawl being received in said slot.

7. A kit as claimed in claim 5, said tooling component drive system including a continuously rotating element, a single revolution clutch connected to said element, a cam connected to said clutch and a cam follower connected between said cam and said tooling component.

8. A kit as claimed in claim 7, said continuously rotating element having coupling means for mating with similar elements of other work station modules.

9. A kit as claimed in claim 5, said work station module including a frame having keying portions mating with keying portions of similar work station modules.

10. In an application tooling machine for electrical connectors of the type having a housing and electrical terminals mounted in the housing, the combination comprising:

a feed track defining a connector feed path slidably receiving electrical connectors for movement along said feed path;

a pusher slidably supported by said feed track for movement parallel with said feed track;

said pusher having connector engaging means extending into said feed path;

first drive means for moving said pusher in order to move electrical connectors in said feed path;

a work station disposed along said feed path including a connector engaging tooling component movable in a path intersecting said feed path;

second drive means for moving said tooling component along said path in a work cycle for performing a work operation on an electrical connector in said feed path;

and the improvement characterized by:

said first drive means including an intermittently operated first drive motor and drive transfer means connected between said first motor and said pusher for moving said carriage a selected distance determined by the magnitude of first drive motor operation;

said second drive means including a continuously operating second drive motor and intermittently operated drive takeoff means connected between said second drive motor and said tooling component for moving said tooling component in said work cycle in response to operation of said drive takeoff means.

11. The combination claimed in claim 10 further comprising a plurality of said work stations, each having one said tooling component and one said drive takeoff means.

12. The combination claimed in claim 10, said first drive motor comprising a stepper motor.

13. The combination claimed in claim 12, said drive transfer means comprising a worm screw and a follower nut.

14. The combination claimed in claim 10, said connector engaging means comprising a retractable pawl carried by said pusher.

15. The combination claimed in claim 10, said drive takeoff means comprising a single revolution clutch connected to said second drive motor, a drive cam connected to the output of said clutch and a cam follower connected between said drive cam and said tooling component.

16. The combination claimed in claim 15, said tooling component comprising a conductor insertion blade for inserting electrical connectors into electrical terminals of said electrical connectors.

17. The combination claimed in claim 15, said tooling component comprising a breakoff tool for removing a carrier strip from electrical terminals of said electrical connectors.

18. Modular application tooling for electrical connectors each having a housing and electrical terminals, said tooling comprising:

a base unit including a connector feed drive system and a work station drive system;

at least one modular feed track unit including a track segment defining a feed track extending along a feed path in a feed direction;

said base unit including a connector delivery unit for delivering electrical connectors to said feed track;

at least one modular pusher unit including a body portion movable in said feed direction and including a pawl member supported by said body portion and receivable into said feed path for advancing electrical connectors along said feed path;

said connector feed drive system including means for selectively moving said pusher unit in said feed direction;

at least one modular work station unit including a tooling component movable relative to said feed path; and at least a first and second of said modular work station units, said work station drive system including a work station drive motor, and said drive takeoff systems of said first and second work station units each including a drive extension element coupled to said work station drive motor and selectively operable drive coupling means connected between said drive extension element and said tooling component;

said work station unit including a drive takeoff system connected between said work station drive system and said tooling component for selectively operating said tooling component.

19. Modular application tooling as claimed in claim 18, said drive extension element of said first work station unit being connected between said work station drive motor and said drive extension element of said second work station unit.

* * * * *